US006163242A

United States Patent [19]

Crewson et al.

[11] Patent Number: 6,163,242

[45] Date of Patent: Dec. 19, 2000

[54] ROTATIONALLY SYMMETRICAL HIGH-VOLTAGE PULSE TRANSFORMER WITH TESLA RESONANCE AND ENERGY RECOVERY

[75] Inventors: Walter Frederick John Crewson, Ridgefield, Conn.; David Kerr Woodburn, Caterham, United Kingdom; Mikael Rolf Lindholm, Enköping, Sweden

[73] Assignee: Scanditronix Medical AB, Uppsala, Sweden

[21] Appl. No.: 09/306,728

[22] Filed: May 7, 1999

[51] Int. Cl.[7] ..... H01F 21/02

[52] U.S. Cl. ..... 336/147; 336/231; 363/131

[58] Field of Search ..... 336/145, 147, 336/182, 231; 363/20, 131

[56] References Cited

U.S. PATENT DOCUMENTS

| | | | |
|---|---|---|---|
| 3,450,996 | 6/1969 | Abramyan et al. | 313/359.1 |
| 3,769,600 | 10/1973 | Denholm et al. | 313/359.1 |
| 4,777,406 | 10/1988 | Ross et al. | 315/3.5 |
| 5,109,326 | 4/1992 | Martin | 363/97 |
| 5,425,166 | 6/1995 | Hastings et al. | 336/234 |
| 5,430,613 | 7/1995 | Hastings et al. | 336/229 |
| 5,521,572 | 5/1996 | Goodwin et al. | 336/184 |
| 5,905,646 | 5/1999 | Crewson et al. | 363/132 |
| 6,021,053 | 2/2000 | Baskette et al. | 363/97 |

*Primary Examiner*—Jeffrey Sterrett
*Attorney, Agent, or Firm*—Young & Thompson

[57] ABSTRACT

A transformer of a Tesla type, and energy supply and particle accelerator devices that include such transformers. The electrical transformer includes a primary winding, a secondary winding which is electromagnetically coupled to the primary winding, and is characterized in that the primary winding consists of one single turn. The transformer operates without any soft magnetic core. The single turn is formed by at least two sector segments of a rotationally symmetric body, over which segments a voltage is applied. Preferably, the segments are equal in size, the voltages are equal in magnitude and one end of each segment is kept at ground potential. In an energy supply and an accelerator according to the present invention, a switch controlling the application of the voltage over the primary winding has controlled turn-on and turn-off preferably is an IGBT switch.

31 Claims, 5 Drawing Sheets

ROTATIONALLY SYMMETRICAL HIGH-VOLTAGE PULSE TRANSFORMER WITH TESLA RESONANCE AND ENERGY RECOVERY

TECHNICAL FIELD

The present invention generally relates to high-voltage transformers and in particular transformers suitable as energy supply devices for electrodynamic particle accelerators.

BACKGROUND

High-energy charged particles are used today for many purposes. General areas of application are e.g. medical treatment, sterilization and material modification. Common to all these methods is that charged particles have to be accelerated under controlled conditions to high energies.

In the field of particle accelerator devices, high voltages are the most common means to obtain accelerated charged particles. Charged particles, in most cases electrons, are emitted from a particle source, usually a filament. The particles are subjected to the field of a high-voltage difference, and are thereby accelerated. The acceleration usually takes place in a vacuum environment, and in applications where irradiation by the charged particles are to be performed under atmospheric pressure, the charged particles are allowed to penetrate radiation windows to escape into the atmospheric environment.

There are two general approaches to achieve the high particle energies. The straight-forward approach is to achieve a high voltage, preferably by a transformer. A relatively moderate voltage at the primary winding of the transformer is transformed to a high voltage at the secondary winding, which voltage can be used for accelerating the charged particles. The most common way is to use an ordinary transformer with an iron core. However, when the voltage rises above 100 kV, the insulation problems become severe.

Another approach is therefore often used for producing the high particle energies. This approach is based on microwave excitation. Such methods are generally expensive and require a lot of complicated and bulky equipment.

A common problem with the above methods according to the state of the art is that the acceleration devices are large and expensive, which makes it impossible to use them in a machine located in a standard production line for most purposes.

There are several proposals for overcoming the limitations of the transformer approach. Since the beam of particles normally is pulsed, the energy transformation in the transformer may utilize resonant behaviors of the equipment. The U.S. Pat. No. 3,450,996 discloses an accelerator device including a Tesla coil transformer. The primary circuit of the Tesla transformer comprises the primary winding and a capacitor, over which the primary voltage is applied. The primary circuit has a certain resonant frequency. A switch controls the current flowing through the primary winding. The secondary circuit comprises the secondary winding, stray capacitances and the load, all connected in parallel. The secondary circuit also has a resonant frequency, which is tuned to be identical with the resonant frequency of the primary circuit.

When closing the switch, the voltage over the primary capacitance will give rise to a current through the primary winding. The current in the primary circuit gives rise to an electromagnetic field, which in turn induces a current in the secondary winding. A voltage over the load in the secondary circuit will eventually build up. The resonant behavior efficiently transfers energy between the primary and secondary circuits. When the peak voltage over the load in the secondary circuit is reached, a short pulse of high-energy particles can be produced. The rest of the energy in the double resonance circuitry is collected back in the primary circuit, the switch is opened and the voltage over the primary capacitance is allowed to build up again.

According to prior art, the method works well in theory, but gives rise to many problems when applying it into practice, at least for very high voltages. A very high voltage on the secondary side requires a very high ratio between the number of turns in the primary and secondary circuits. A huge number of secondary turns is not easily achievable, so the number of primary turns has to be limited. However, a turns ratio above 100 is not easy to achieve according to the prior art. This means, for instance, that if a final secondary voltage of above 1 MV is required, the voltage of the primary side has to be of the order of 10 kV.

The insulation problems become severe, and an ordinary iron core design can not be used. In the patent U.S. Pat. No. 3,450,996, a magnetic conductor is disposed outside the primary circuit, in order to insulate it from the high voltages of the secondary circuit.

In order to operate the transformer of U.S. Pat. No. 3,450,996, the switch has to be operable at high voltages, both for opening and for closing. If the pulse duration is short, this opening and closing has to be performed very accurately and fast. For handling voltages up to 10 kV, thyristor devices have to be used. However, the opening times and precision for such equipment are limited, Furthermore, the devices have to recover after an opening before they can be closed again. This makes it necessary to incorporate complicated circuitry to accomplish the required high frequency switching.

During recent years, the technology of IGBT (Integrated Gate Bipolar Transistor) has provided electronically controlled high-voltage switches, which can accomplish both relatively fast turn-on and turn-off with high precision. However, today, the IGBT is limited to a maximum voltage of about 2 kV, which makes them unsuitable for applications of very high-voltages. One solution would in theory be to stack a number of IGBTs on top of each other, and control the turn-on and turn-off simultaneously. However, when dealing with turn-on and turn-off times in the order of microseconds, the synchronization becomes a severe problem. If the time when each of the IGBTs is turned on is not the same, the total voltage over the stack will be placed over the last IGBT to be turned on, which is likely to lead to the destruction of this component.

Devices for producing short pulses of high-voltage according to prior art are therefore expensive, bulky and require extremely complicated control electronics.

SUMMARY

The general object of the present invention is to provide a device and a method for producing high-voltage pulses by utilizing an electrical transformer, which device is relatively simple, cheap and small.

A particular object of the present invention is to provide an electrical transformer, which works with a limited primary voltage, and which gives rise to a large ratio between primary and secondary voltage. Another object of the present invention is to provide a transformer, which improves the utilization of a Tesla resonance. A further object of the present invention is to provide an energy supply means for an electrodynamic particle accelerator, which is operable with very high voltages. Another object of the present invention is to provide a method for producing short pulses of high voltage, which requires less complicated control electronics. Yet another object of the present invention is to provide an achievable method for recovering any energy not used in a given pulse, for use in the next pulse, thus achieving high efficiency.

The above objects are accomplished by devices and methods according to the enclosed claims. In general, an electrical transformer according to the invention comprises a primary winding, a secondary winding which is electromagnetically coupled to the primary winding, and characterized in that the primary winding consists of one single turn.

In a general transformer according to the present invention, the single turn is formed by at least two sector segments of a rotationally symmetric body, over which segments a voltage is applied. Preferably, the segments are equal in size, the voltages are equal in magnitude and one end of each segment is kept at ground potential.

An energy supply means and an accelerator according to the present invention, the general transformer is of a Tesla type, where a switch controlling the application of a voltage over a primary winding has electronically controlled turn-on and turn-off. The electromagnetic coupling between the primary coil and a secondary coil is preferably selected according to $$k=(n^2-m^2)/(n^2+m^2),$$

where n and m are positive integers and n=m+1. The electronically controlled switches comprises preferably IGBT switches.

The method according to the present invention comprises the step of applying a primary voltage simultaneously over at least two segments of a primary winding. The method comprises preferably the step of disconnecting the voltage over the primary winding when the secondary circuit contains an electric energy of substantially zero magnitude, thereby returning any energy not delivered to any secondary load to the primary circuit for use in the next pulse.

BRIEF DESCRIPTION OF THE DRAWINGS

The invention, together with further objects and advantages thereof, may best be understood by making reference to the following description taken together with the accompanying drawings, in which.

DETAILED DESCRIPTION

Figure 1:
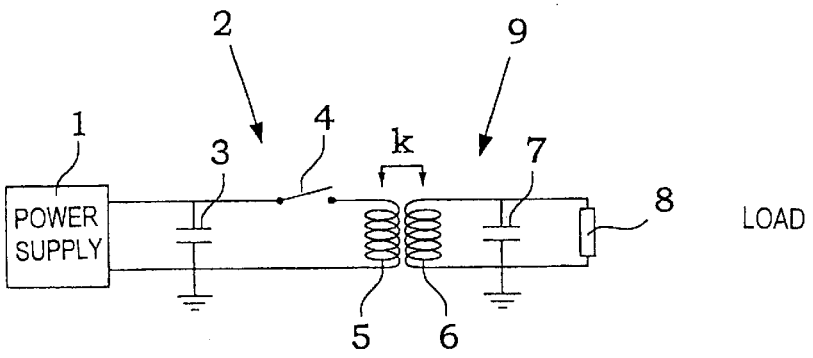
Fig. 1 (PRIOR ART)
FIG. 1 is an illustration of the electrical connections of a Tesla transformer.

In FIG. 1, a general Tesla transformer design is illustrated. A DC power supply 1 provides a voltage over a primary capacitor 3 of a primary circuit 2. The primary circuit 2 further comprises a primary winding 5 and a switching means 4 connected in series with each other and in parallel with the primary capacitor 3 and the power supply 1. A secondary circuit 9, comprises a secondary winding 6, which is electromagnetically coupled to the primary winding 5 by a certain coefficient k. In parallel with the secondary winding 6 a secondary capacitor 7 and a load 8 is connected. Each one of the circuits 2, 9 has a resonant frequency, which is tuned to be identical for the two circuits.

By opening the switch means 4 the primary capacitor 3 charges up to the voltage of the voltage supply 1. When the switch means 4 is closed, a primary current starts to flow through the primary coil 5, giving rise to an electromagnetic field, which in turn influences the secondary coil 6 and induces a secondary current. The current through the secondary coil 6 charges up the secondary capacitor 7 and gives rise to a secondary voltage over the load 8. The load 8 may in a typical case be an electron beam accelerator arrangement. Energy is thus transferred from the primary circuit 2 to the secondary circuit 9. If the electromagnetic coupling coefficient between the coils is selected in a certain manner, described below, there will be a situation, where a total energy transfer is made from the primary circuit 2 to the secondary circuit.

Figure 2:
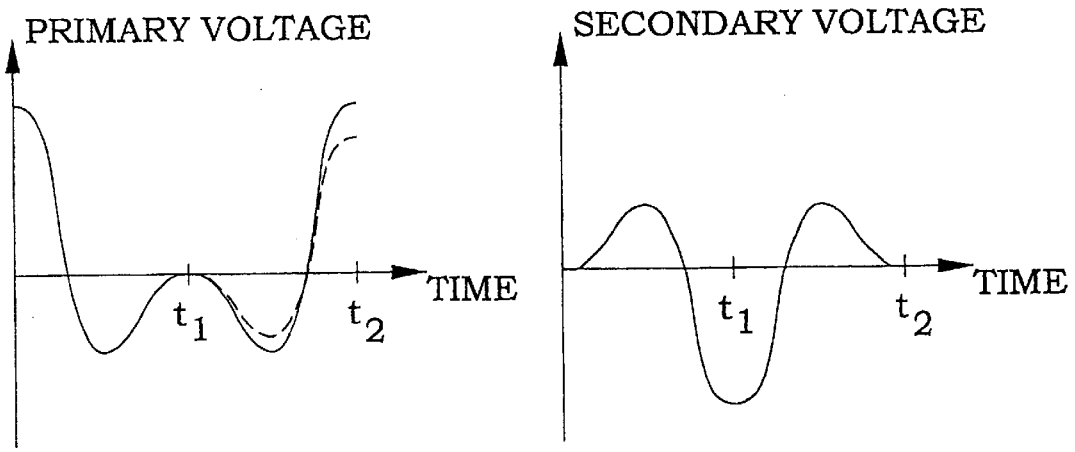
Fig. 2 (PRIOR ART)
FIG. 2 is a diagram illustrating the variation of voltages of the primary and secondary windings in a Tesla transformer.

FIG. 2 shows two diagrams, illustrating voltages over the primary and secondary capacitances as a function of time for a Tesla transformer having an electromagnetic coupling coefficient of 0.6. At the time t=0, the switch in the primary circuit is opened. The voltage over the primary capacitance drops and the voltage over the secondary capacitance increases. The primary capacitance voltage drops below zero and reaches a negative peak value. At the same time, the secondary capacitance voltage goes through a positive peak value and decreases thereafter. If the electromagnetic coupling coefficient is 0.6, there is a time $t_1$, when the primary circuit voltage is zero and the secondary circuit voltage at the same time reaches a maximum deviation from zero voltage. This means that the entire energy, originally available in the primary circuit has been transferred to the secondary circuit. As anyone skilled in the art understands, this reasoning is only valid for ideal resistance-less windings etc. However, also in practice, all energy, not wasted as heat losses in the circuitry, is indeed transferred to the secondary circuit.

If the electromagnetic actions are allowed to continue, the following process will be exactly the opposite. That means, that at a time $t_2$, all energy in the transformer is returned back.

In the application of electrodynamic accelerators, it is requested to use the high voltage on the secondary side in order to accelerate electrons. In order to have a controllable and relatively monochromatic electron beam, the extraction of electrons is requested to be performed only during a short period around the voltage peak of the secondary circuit. In such a case, some energy is consumed at the secondary circuit during a short period around $t_1$. This will result in a decreased voltage of the primary and secondary circuits according to the dotted line in FIG. 2.

The basic principles of the Tesla transformer is known since earlier, but the use in high-voltage applications has mainly been restricted by the lack of suitable switching means. In order to achieve a high voltage, e.g. above 500 kV, at the secondary side, a requested solution would be to use also a relatively high primary voltage, such as 5 to 10 kV. The ratio of the transformation may in such a case be relatively restricted, which is of benefit for the copper losses in the secondary circuit. The limited number of turns in the secondary winding gives a lower winding inductance, which results in a higher self-resonant frequency of the transformer. However, no suitable switching means were available for this solution. Furthermore, in order to increase the coupling between the primary and secondary circuits, iron core or at least partly iron mediated transformers were wanted, despite the introduction of iron losses, in particular at high frequencies. However, such transformers were never used in any wider applications due to the insulation problems occurring at voltages above about 100 kV.

In order to build a transformer being able to provide high voltage pulses over 100 kV, and preferably over 1 MV, a totally new approach has to be used. The iron core is excluded, which reduces the coupling coefficient between the primary and secondary circuits. It is thus possible to use high secondary voltages without complicated and expensive insulation means. This also has the benefit of excluding the iron losses, which are noticeable at high frequencies. Instead, the ratio of the transformation was increased, increasing the copper losses, but allowing for reducing the primary voltage. A transformer with a multi-turn primary winding is known in prior art. A transformer with a primary winding of only one single turn may, however, also be used. The voltage over the primary winding may also be further decreased by introducing also segmentation of the single turn, as described more in detail below.

By doing this, the primary voltage may be reduced sufficiently in order to be able to use electronically controlled switches, a choice which earlier was totally out of the question, due to the high primary voltage. Solid state switches, so called IGBT switches (Integrated Gate Bipolar Transistors). IGBT switches are now available up to a maximum voltage of about 2 kV, which makes them possible to use, together with the other features of the present invention. Furthermore, the relatively slow turn-on rise times are preferably for high frequency applications, e.g. above 100 kHz, compensated by additional switching devices, described more in detail below.

In the Tesla transformer example of FIG. 2, the coupling coefficient was 0.6, which may be difficult to achieve without any iron core. However, a Tesla transformer may operate in resonance for any coupling coefficient which fulfills the relation $$k=(n^2-m^2)/(n^2+m^2),$$

where n and m are positive integers and n=m+1. The 0.6 case corresponds to the choice of n=2 and m=1. By instead selecting n=3 and m=2, giving a coupling coefficient of 0.385, the Tesla transformer still operates in a resonant manner, giving a total energy transport to the secondary winding. Such a coupling coefficient is easily achievable also by air or vacuum core transformers. The resonance behavior will then differ from the one shown in FIG. 2, presenting further oscillations before the maximum secondary voltage is reached. Also other choices of n and m are possible to use.

Figure 3:
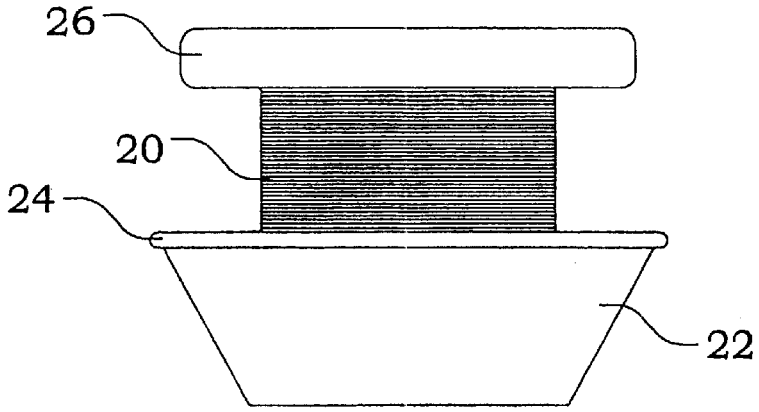
FIG. 3 is a view of an embodiment of a transformer usable in the present invention.

FIG. 3 is a side view of an embodiment of a transformer arrangement adjusted to give giving a secondary peak voltage of 200 kV. A typical arrangement for a pulsed Tesla transformer is a secondary winding 20, with a height which is about equal to its diameter, surrounded by a conical primary winding 22 of a single turn. This primary winding rises to half the height of the secondary, and is formed in the shape of a hollow frustum of a cone. The lower parts of the windings are grounded, which leads to that the voltage between the top of the primary and the closest part of the secondary is about half the voltage of the secondary circuit. On top of the secondary winding 20, the gun terminal 26, for which the high voltage pulse is produced, is present. The secondary circuit comprises a capacitor in the form of the vacuum capacitance between the secondary terminal and the vacuum tank. The inductance of the secondary winding and this secondary capacitor determines the resonant frequency of the secondary circuit. The capacitance is normally in the order of 50 to 100 pF and a typical inductance may be around 5 H. The primary circuit is also provided with a capacitor, adjusted to give the same resonant frequency, together with the inductance of the primary winding, as the secondary circuit resonant frequency. Typical values may here e.g. be 100 $\mu$F and 2.5 $\mu$H, which gives a resonant frequency of 63 kHz.

The secondary winding is preferably composed of two nested coaxial single-layer coils of copper wire. Copper wire is advantageously because of its slow out-gassing in a vacuum. A winding for 200 kV is about 10 cm high, and the diameter of the outer coil. The voltage between the upper part of the primary cone and the closest part of the secondary is about 100 kV. If a maximum allowed electrical field is 40 kV/cm, the coaxial geometry provides that the ratio between the primary maximum diameter and the diameter of the secondary winding has to be at least $e^{1/2}$. The angle between the primary and secondary winding then has to be about 33 degrees.

The primary turn is preferably capped by a stainless-steel ring 24, which is split at one or more points around its circumference to prevent current from circulating around it and creating a shorted turn. The tubing that forms this ring 24 should have a radius of 2–3 cm. Its function is to reduce the enhancement of electric field a t the upper edge of the primary turn, and reduce the probability of vacuum breakdown along that edge. The ring 24 should be grounded to the vacuum tank with a low-inductance conductor, i.e. short and wide. This will help to protect the primary driving system from damage. The high current in such an arc will flow to ground via the ring 24, and will not pass into the primary driver system. For systems operating at even higher voltages, the cap may be formed by a couple of rings, grouped to resemble a single larger ring, to keep the local electric field magnitude down.

One important feature of the present invention is to reduce the maximum voltage necessary to drive the primary circuit. In order to produce an electromagnetic field, which induces a current in the secondary winding, a voltage over the primary winding, changing its magnitude in time, has to be present. However, it is only the gradient of the potential, i.e. the derivative of the voltage, that determines the induced electromagnetic field. The absolute values of the voltages are unimportant since any constant values disappear during derivation. An embodiment of the present invention therefore comprises a primary winding of one single turn, which single turn is divided in to sector segments. Each sector segment is provided with a voltage between its ends The time derivative of the voltage over the segment gives an induced electromagnetic field. In a preferred embodiment, the segments are equal in size, and are supplied with equal voltages with equal time derivatives. The total effect of the voltage variation of the segments will be approximately the same as if a continuous single turn was used.

Figure 4:
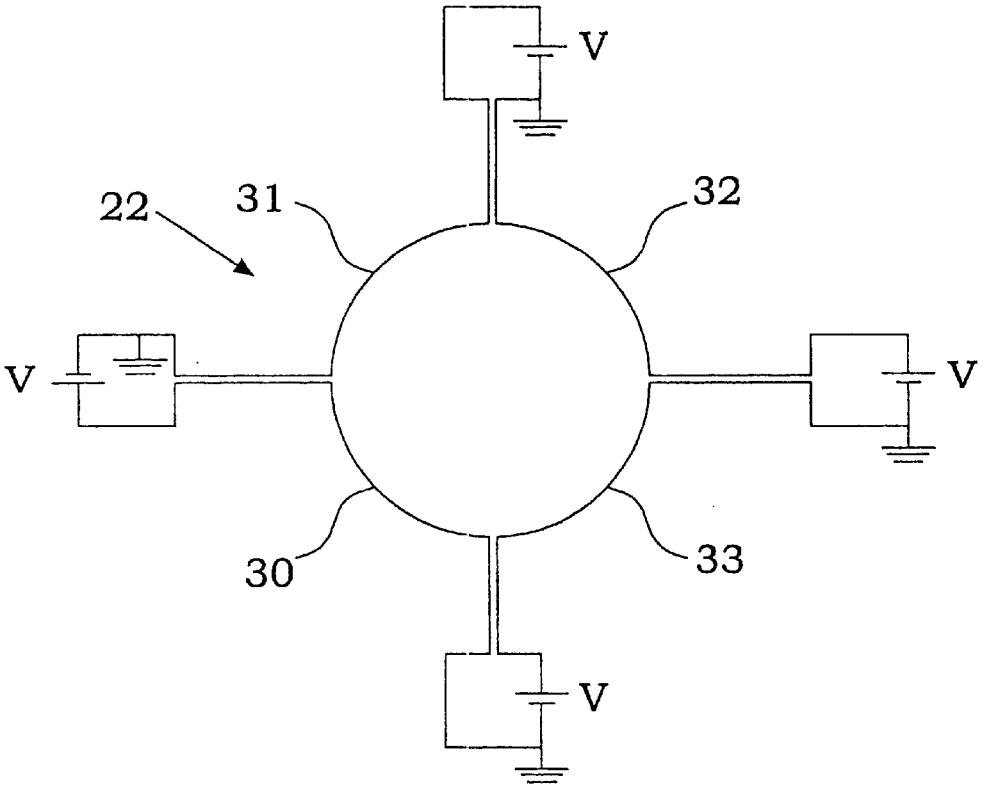
FIG. 4 is an illustration of the electrical connections of a primary winding divided into sector segments according to the present invention.

FIG. 4 schematically illustrates the electrical connections of a primary winding 22 according to an embodiment of the present invention, having a single turn with four sectors 30–33. Each sector 30–33 is supplied with a voltage V and is grounded at one end. If the voltages are controlled with the same characteristics, the total primary winding will act as if there was a continuous single turn, if the edge effects at the segment edges are neglected. However, the maximum voltage present at the primary winding is only one fourth of the one necessary for driving a continuous single turn, In this way, the effective maximum voltage at the primary side can be kept low.

Figure 5:
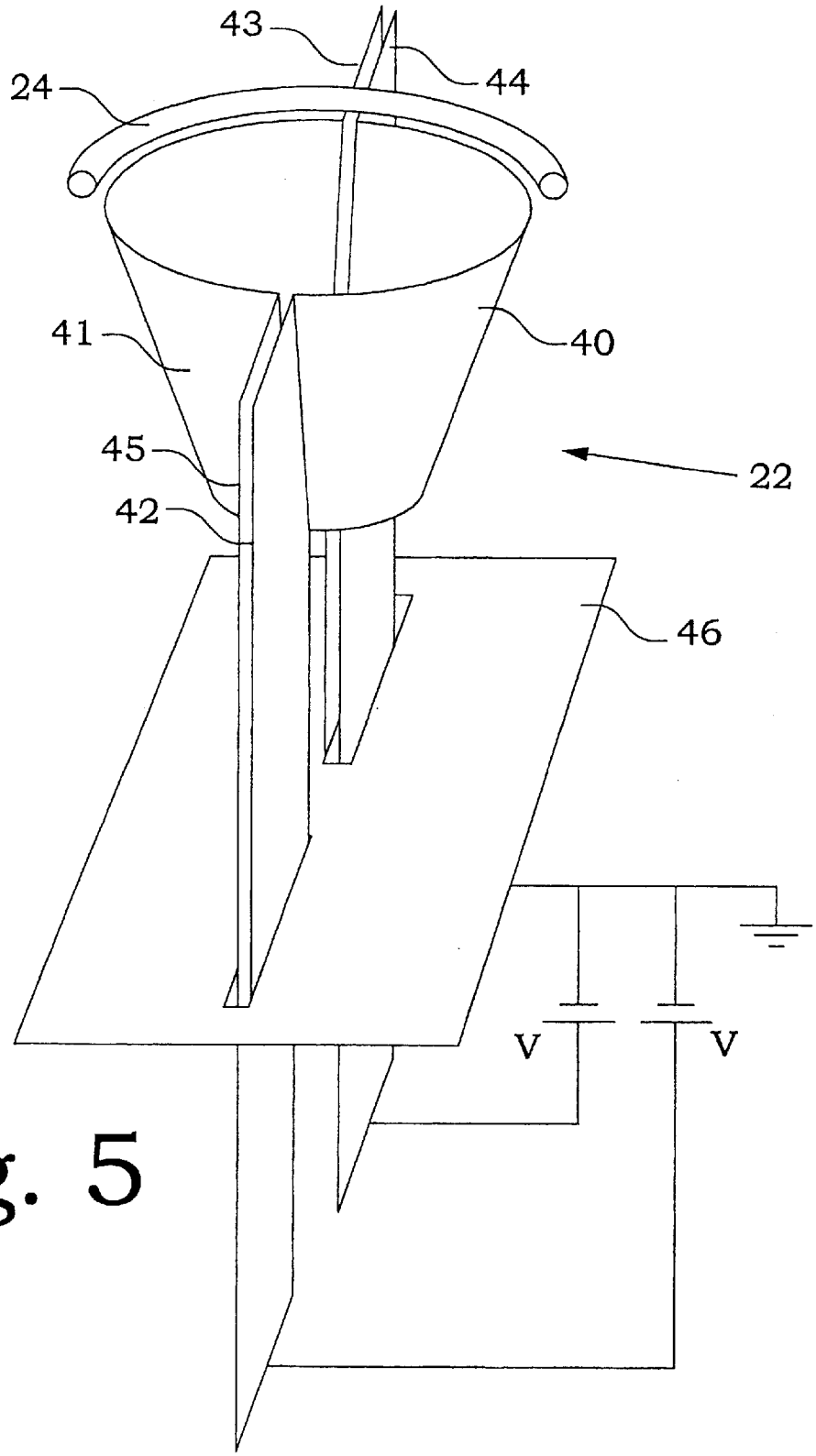
FIG. 5 is a view, partially in cross section, of a primary winding according to the present invention.

FIG. 5 illustrates a view of an embodiment of a primary winding 22 possible to use in the present invention, having a single turn comprising two segments 40, 41. A ring cap 24 is provided above the upper end of the segments, as described earlier. The segments 40, 41 are sector segments of a rotationally symmetric body, in this case a hollow frustum of a cone. The segments are provided with electrical connections 42–45, for applying a voltage over the segments 40, 41. The voltage is applied between a first end and a second end, in circumferential direction. Two of the electrical connections are in this embodiment ground connections 42, 43, connecting a first end of the segments 40, 41 to a ground plane 46, which is kept at ground potential. The other connections 44, 45 connects a second end of the segments 40, 41 to a voltage V. The first end of one segment is juxtaposed with the second end of the other segment.

If the voltage over the primary winding is kept low, e.g. by segmenting the single primary turn, there are a few possibilities to arrange for the primary switching means. The switching means of the present invention has electronically controlled turn-on and turn-off. By carefully controlling the turn-on of the primary voltage, the Tesla resonance can be started in a proper manner. By turning it off, when both the current and voltage are zero in the secondary circuit, all energy, not used for the load or lost as copper losses or eddy currents, is returned to the primary capacitor for use in the next pulse. In this manner, the efficiency becomes very high, and the heat losses necessary to dissipate are low.

Figure 6A:
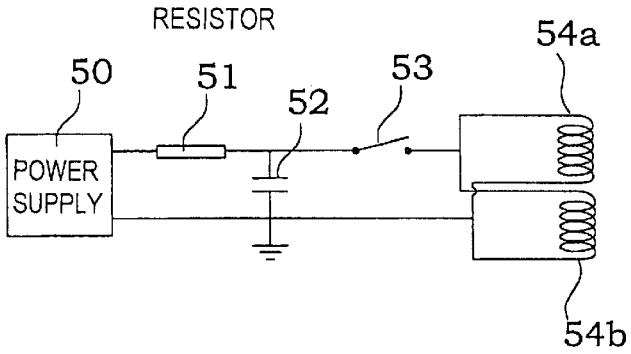
FIGS. 6*a* and 6*b* are illustrations of electrical connections in the voltage supply for a primary winding divided in sector segments.
Figure 6B:
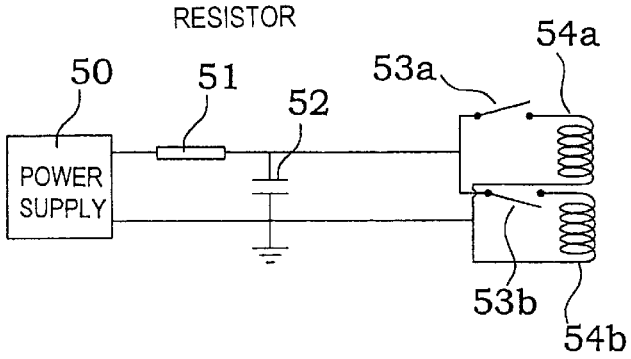

One possibility is to use IGBT switches in the switching means. IGBT switches of today may handle up to 2 kV and a considerable current. FIG. 6*a* illustrates an electrical connection scheme of a primary circuit with a primary winding comprising two segments 54*a* and 54*b* connected in parallel. A DC power supply provides a voltage through a resistance 51 to a primary capacitor 52. A switching means 53, preferably comprising an IGBT switch is connected in series with the segments 54*a* and 54*b*. One single IGBT switch then may operate both segments 54*a*, 54*b*. If the current through the segments 54*a* and 54*b* is large, an alternative connection shown in FIG. 6*b* is preferred. Here two switching means 53*a* and 53*b* are connected in series with one segment 54*a* and 54*b*, respectively, which reduces the current flowing through each one of the IGBT switches.

Figure 7:
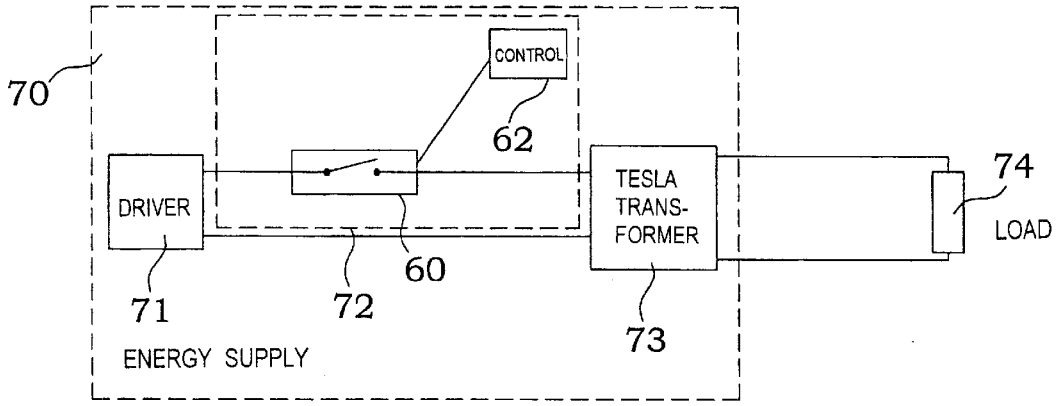
FIG. 7 is a block diagram of an embodiment of an energy supply means according to the present invention.

An energy supply means 70 according to one embodiment of the present invention is illustrated in FIG. 7. A driving circuit 71 is connected via a switching means 72 to a Tesla transformer 73. The output voltage from the Tesla transformer 73 constitutes the terminals of the energy supply means 70, and are connected to a load 74. The switching means 72 comprises an electronically controlled switch 60, preferably an IGBT switch, and control means 62 therefore.

The Tesla transformer of the energy supply means of FIG. 7 is preferably formed according to the discussions above.

The main intended application field of the present invention is particle accelerators. The energy transformation features according to the present invention is suitable for accelerators with pulsed particle emission, where the accelerating action is preformed by a time varying electric field. Such particle accelerators may be denoted as electrodynamic accelerators.

Figure 8:
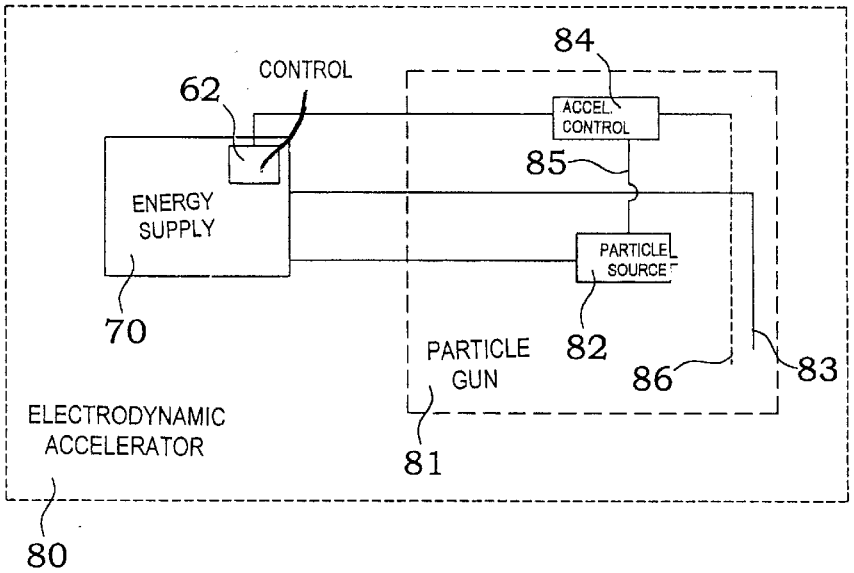
FIG. 8 is a block diagram of an embodiment of an electrodynamic particle accelerator according to the present invention.

An electrodynamic accelerator device 80 according to the present invention is illustrated as a block scheme in FIG. 8. The actual design of the particle extraction means, the geometrical design of such parts and the mechanical and vacuum design can be any suitable technique used in the prior art, and is not the object of the present invention. The illustrated embodiment of the accelerator The electrodynamic accelerator device 80 comprises an energy supply means 70, according to the above descriptions. The energy supply means 70 is connected to a particle gun assembly 81. The particle gun assembly 81 uses the high voltage of the energy supply means 70 to extract and accelerate charged particles, in particular electrons. The particle gun assembly 81 comprises a particle source 82, typically an electron gun filament, connected to one of the energy supply means connections, and an acceleration structure 83, which typically may be constituted by e.g. an electrode connected to the vacuum enclosure. In a typical case, electrons are emitted from the particle source 82 and accelerated towards the acceleration structure 83. Preferably, the particle gun assembly 81 also comprises acceleration control means 84, which controls the particle emission from the particle source 82. This may e.g. be realized by direct control of the particle source by a control connection 85 or by controlling a grid structure 86 prohibiting the particles to feel the accelerating potentials. Many suitable techniques to implement these features are available in prior art. The acceleration control means 84 is preferably synchronized with the control means 62 of the energy supply means 70.

It will be understood by those skilled in the art that various modifications and changes may be made to the present invention without departure from the scope thereof, which is defined by the appended claims.

What is claimed is:

1. An electrical transformer comprising:

a primary winding, and a secondary winding, electromagnetically coupled to said primary winding, said primary winding consisting of one single turn and being formed by at least two sector segments of a rotationally symmetric body.

2. The electrical transformer according to claim 1, wherein said sector segments comprise electrical connections for applying a sector segment voltage between a first end and a second end, in circumferential direction, of each one of said sector segments.

3. The electrical transformer according to claim 2, wherein said sector segments are of equal size and said sector segment voltages are of equal magnitude.

4. The electrical transformer according to claim 3, wherein said first end of each one of said sector segments is kept at a common electric potential, whereby said first end of one sector segment is juxtaposed with said second end of another sector segment.

5. The electrical transformer according to claim 4, wherein said common electric is at ground potential.

6. The electrical transformer according to claim 1, wherein said sector segments are substantially sector segments of a hollow frustum of a cone.

7. The electrical transformer according to claim 1, wherein said electromagnetic coupling occurs in vacuum or a gas in the absence of a ferromagnetic core.

8. An energy supply device comprising a voltage supply, and a transformer having a primary circuit having a primary winding and connected to said voltage supply, and a switching means controlling the application of a voltage of said voltage supply over said primary winding, said primary circuit having a resonant frequency, a secondary circuit, having a secondary winding, electromagnetically coupled to said primary winding, said secondary circuit having the same resonant frequency as said primary circuit, said primary winding consisting of one single turn, and being formed by at least two sector segments of a rotationally symmetric body, and said switching means has controlled turn-on and turn-off.

9. The device according to claim 8, wherein said electromagnetic coupling between said primary winding and said secondary winding is selected substantially according to $$k=(n^2-m^2)/(n^2+m^2)$$

where n and m are positive integers and n=m+1.

10. The device according to claim 8, wherein said sector segments comprise electrical connections for applying a sector segment voltage between a first end and a second end, in circumferential direction, of each one of said sector segments.

11. The device according to claim 10, wherein said sector segments are of equal size, and said sector segment voltages are of equal magnitude.

12. The device according to claim 11, wherein said first end of each one of said sector segments is kept at a common electric potential, whereby said first end of one sector segment is juxtaposed with said second end of another sector segment.

13. The device according to claim 12, wherein said sector segment voltage is supplied by said voltage supply and in that said primary circuit comprises a number of switching means, having controlled turn-on and turn-off, each of said controlled switching means controls the application of said sector segment voltage to one of said sector segments.

14. The device according to claim 13, wherein said controlled switching means comprises an IGBT switch.

15. An electrodynamic accelerator device, comprising a voltage supply, a particle gun assembly, and a transformer having a primary circuit having a primary winding and being connected to said voltage supply, and a switching means controlling the application of a voltage of said voltage supply over said primary winding, said primary circuit having a resonant frequency, a secondary circuit, having a secondary winding, electromagnetically coupled to said primary winding, said secondary circuit having the same resonance frequency as said primary circuit and being electrically connected to said particle gun assembly, said primary winding consisting of one single turn, and being formed by at least two sector segments of a rotationally symmetric body, and said switching means has controlled turn-on and turn-off.

16. The device according to claim 15, wherein said electromagnetic coupling between said primary winding and said secondary winding is selected substantially according to $$k=(n^2-m^2)/(n^2+m^2)$$

where n and m are positive integers and n=m+1.

17. The device according to claim 15, wherein said sector segments comprise electrical connections for applying a sector segment voltage between a first end and a second end, in circumferential direction, of each one of said sector segments.

18. The device according to claim 17, wherein said sector segments are of equal size, and said sector segment voltages are of equal magnitude.

19. The device according to claim 18, wherein said first end of each one of said sector segments is kept at a common electric potential, whereby said first end of one sector segment is juxtaposed with said second end of another sector segment.

20. The device according to claim 19, wherein said sector segment voltage is supplied by said voltage supply arid in that said primary circuit comprises a number of switching means, having controlled turn-on and turn-off, each of said controlled switching means controls the application of said sector segment voltage to one of said sector segments.

21. The device according to claim 20, wherein said controlled switching means comprises an IGBT switch.

22. A method for producing electrical pulses with a voltage above 100 kV, comprising the steps of:

applying a primary voltage substantially simultaneously over each one of at least two sector segments of a primary winding, giving rise to a primary current;

producing an electromagnetic field through said primary winding;

inducing a secondary current in a secondary winding, by using electromagnetic coupling in vacuum or a gas in the absence of a ferromagnetic core, giving rise to a secondary voltage.

23. The method for producing electrical pulses according to claim 22, further comprising the step of connecting one end of each of said sector segments to a common potential.

24. The method for producing electrical pulses according to claim 23, wherein said common potential is ground potential.

25. The method for producing electrical pulses according to claim 22, wherein said primary voltage of each one of said sector segments are equal.

26. The method for producing electrical pulses according to claim 22, further comprising the step of tuning the resonance frequency of a primary circuit comprising said primary winding and the resonance frequency of a secondary circuit comprising said secondary winding to agree.

27. The method for producing electrical pulses according to claim 26, further comprising the step of tuning the electromagnetic coupling between said primary and secondary winding according to $$k=(n^2-m^2)/(n^2+m^2)$$

where n and m are positive integers and n=m+1.

28. The method for producing electrical pulses according to claim 26, further comprising the step of disconnecting said primary winding when said primary voltage is substantially zero.

29. The method for producing electrical pulses according to claim 28, further comprising the step of returning any energy not delivered to a particle beam or lost in heat to said primary circuit for use in a next pulse.

30. The method for producing electrical pulses according to claim 26, further comprising the step of disconnecting said primary winding when said secondary circuit contains an electric energy of substantially zero magnitude.

31. The method for producing electrical pulses according to claim 30, further comprising the step of returning any energy not delivered to a particle beam or lost in heat to said primary circuit for use in a next pulse.

* * * * *

UNITED STATES PATENT AND TRADEMARK OFFICE

CERTIFICATE OF CORRECTION

PATENT NO. : 6,163,242

DATED : December 19, 2000

INVENTOR(S) : Walter Frederick John CREWSON et al.

It is certified that error appears in the above-indentified patent and that said Letters Patent is hereby corrected as shown below:

Claim 20, line 2, change "arid" to --and--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*